US010384209B2

(12) United States Patent
Chen et al.

(10) Patent No.: US 10,384,209 B2
(45) Date of Patent: Aug. 20, 2019

(54) MICROFLUIDIC PLATFORM AND METHOD FOR CONTROLLING THE SAME

(75) Inventors: Qiu Lan Chen, Guangzhou (CN); Ho Pui Ho, Hong Kong (CN); Siu Kai Kong, Hong Kong (CN); Patrick Kwok Leung Kwan, Hong Kong (CN); Yiu Wa Kwan, Hong Kong (CN); Ho Chin Kwok, Hong Kong (CN); Ping Shum, Nanyang Heights (SG); Yick Keung Suen, Hong Kong (CN); Shu Yuen Wu, Hong Kong (CN); Alice Kar Lai Yang, Hong Kong (CN); Jun Qiang Zhou, Singapore (SG)

(73) Assignees: THE CHINESE UNIVERSITY OF HONG KONG, Hong Kong (CN); NANYANG TECHNOLOGICAL UNIVERSITY, Singapore (SG); HOSPITAL AUTHORITY, Hong Kong (CN)

( * ) Notice: Subject to any disclaimer, the term of this patent is extended or adjusted under 35 U.S.C. 154(b) by 1200 days.

(21) Appl. No.: 14/344,827

(22) PCT Filed: Sep. 10, 2012

(86) PCT No.: PCT/CN2012/081197

§ 371 (c)(1),
(2), (4) Date: Oct. 13, 2014

(87) PCT Pub. No.: WO2013/037284

PCT Pub. Date: Mar. 21, 2013

(65) Prior Publication Data

US 2015/0027555 A1 Jan. 29, 2015

Related U.S. Application Data

(60) Provisional application No. 61/535,249, filed on Sep. 15, 2011.

(51) Int. Cl.
*B01L 7/00* (2006.01)
*B01L 3/00* (2006.01)

(52) U.S. Cl.
CPC ..... *B01L 7/525* (2013.01); *B01L 3/50273* (2013.01); *B01L 3/502784* (2013.01);
(Continued)

(58) Field of Classification Search
CPC ..... B01L 2200/0673; B01L 2300/0803; B01L 2300/1811; B01L 2300/1816;
(Continued)

(56) References Cited

U.S. PATENT DOCUMENTS 5,639,428 A 6/1997 Cottingham
6,063,589 A * 5/2000 Kellogg ..... B01F 13/0059 366/DIG. 3

(Continued)

FOREIGN PATENT DOCUMENTS

CN 2596363 Y 12/2003
CN 101086504 A 12/2007
EP 1 813 683 A1 8/2007

*Primary Examiner* — Lyle Alexander
*Assistant Examiner* — Bryan Kilpatrick
(74) *Attorney, Agent, or Firm* — Knobbe, Martens, Olson & Bear LLP

(57) ABSTRACT

A microfluidic platform including a microfluidic layer and a contact layer. The microfluidic layer is embedded with a microfluidic structure including a micro-channel and a fluidic sample contained in the micro-channel. The contact layer is able to be attached to the microfluidic layer, and includes a first heater for heating a first area of the microfluidic structure to a first temperature and a second heater for heating a second area of the microfluidic structure to a second temperature. The microfluidic layer and the contact (Continued)

layer rotate together during operation. A method for controlling a sample in the micro-channel of the microfluidic structure.

15 Claims, 3 Drawing Sheets

(52) U.S. Cl.
CPC . *B01L 3/502715* (2013.01); *B01L 2200/0673* (2013.01); *B01L 2300/0803* (2013.01); *B01L 2300/1811* (2013.01); *B01L 2300/1816* (2013.01); *B01L 2300/1822* (2013.01); *B01L 2300/1827* (2013.01); *B01L 2300/1861* (2013.01); *B01L 2400/0409* (2013.01); *Y10T 137/0391* (2015.04); *Y10T 137/6525* (2015.04); *Y10T 137/6606* (2015.04)

(58) Field of Classification Search
CPC ..... B01L 2300/1822; B01L 2300/1827; B01L 2400/0409; B01L 3/50273; B01L 3/502784; B01L 7/525; Y10T 137/6606
See application file for complete search history.

(56) References Cited

U.S. PATENT DOCUMENTS

| | | | |
|---|---|---|---|
| 6,527,432 | B2 | 3/2003 | Kellogg et al. |
| 6,706,519 | B1 | 3/2004 | Kellogg et al. |
| 7,061,594 | B2 | 6/2006 | Worthington et al. |
| 7,141,416 | B2 | 11/2006 | Krutzik |
| 2008/0274513 | A1 | 11/2008 | Shenderov et al. |
| 2008/0314454 | A1 | 12/2008 | Delattre et al. |
| 2009/0075801 | A1 | 3/2009 | Hodko et al. |
| 2010/0288382 | A1* | 11/2010 | Levent ..... B01L 3/502707 137/565.26 |
| 2011/0048951 | A1 | 3/2011 | Wu |
| 2012/0289429 | A1 | 11/2012 | Chen et al. |

* cited by examiner

MICROFLUIDIC PLATFORM AND METHOD FOR CONTROLLING THE SAME

This application is the U.S. National Phase under 35 U.S.C. § 371 of International Application PCT/CN2012/081197, filed Sep. 10, 2012, designating the U.S., and published in English as WO 2013/037284 on Mar. 21, 2013, which claims priority under 35 U.S.C. § 119(e) to U.S. Provisional Application No. 61/535,249, filed Sep. 15, 2011, the entire contents of which are incorporated herein by reference.

TECHNICAL FIELD

The present application relates to a microfluidic platform and a method for controlling the same.

BACKGROUND

Microfluidic systems are becoming increasingly important in many application areas such as biotechnology, diagnostics, medical or pharmaceutical industries. Microfluidic systems also lead to a concept of lab-on-a-chip, which is the integration of an entire bio/chemical laboratory onto a single silicon or polymer chip.

For realizing such microfluidic systems, a driving force moves samples within microfluidic structures. Centrifugal force is one of the forces generated by rotating the microfluidic systems typically on a compact disc-shaped substrate. With a suitable design of microchannels, valves, vents, chambers, etc., the functions such as fluid transport, splitting, merging can be realized. See for example U.S. Pat. Nos. 6,527,432 7,061,594 and 7,141,416. However, the microfluidic structures and platforms disclosed therein are only for assays with reaction under room temperature. For functions such as DNA extraction, loop-mediated isothermal amplification and polymerase chain reaction, a higher temperate is needed. This requires temperature control components to be attached to areas of the microfluidic structures where temperature variation is needed. See for example U.S. Pat. Nos. 5,639,428 and 6,706,519, and European Patent Application EP 1,813,683 A1. However, the methods for changing the sample temperature disclosed therein are realized through changing the temperature of heating elements and heating areas of the microfluidic structure, which is time consuming.

SUMMARY

Therefore, an objective of the present application is to provide a microfluidic platform which supports the microfluidic structures for integrated sample preparation and analysis under both room and high temperatures and reduces the time to introduce the required temperature changes in the samples. It is also an objective of the present application to provide a microfluidic platform which reduces formation of air bubbles in the microfluidic structure. It is a further objective of the present application to provide a method for controlling a microfluidic platform comprising a micro-channel contained a sample therein.

According to one aspect of the present application, a microfluidic platform comprising a microfluidic layer and a contact layer attachable to the microfluidic layer is provided. The microfluidic layer is embedded with a microfluidic structure comprising a micro-channel and a fluidic sample contained in the micro-channel. The contact layer comprises a first heater for heating a first area of the microfluidic structure to a first temperature and a second heater for heating a second area of the microfluidic structure to a second temperature. The microfluidic layer and the contact layer rotate together during operation.

According to another aspect of the present application, a method for controlling a microfluidic platform comprising a micro-channel contained a sample therein is provided. The method comprises steps of: heating a first area and a second area of the micro-channel to a first temperature and a second temperature, respectively; rotating the microfluidic structure to move the sample to the first area; maintaining the sample at the first area for a first period of time; rotating the microfluidic structure to move the sample to the second area; and maintaining the sample at the second area for a second period of time.

BRIEF DESCRIPTION OF THE DRAWINGS

The following figures illustrate various exemplary embodiments of the present application. However, it should be noted that the present application is not limited to the exemplary embodiments illustrated in the following figures.

DETAILED DESCRIPTION

Hereinafter, embodiments according to the present application are described in detail with reference to accompanying drawings for an illustration purpose.

Figure 1:
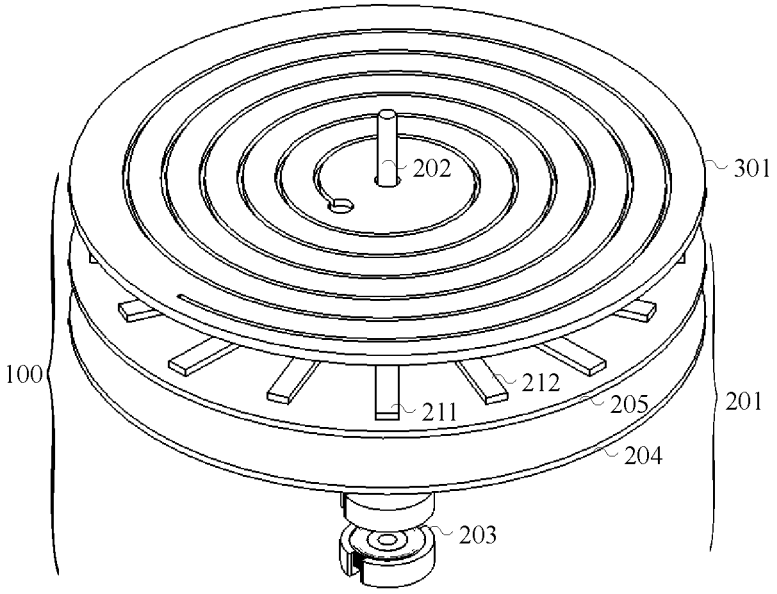
FIG. 1 is a schematic view of a microfluidic platform according to an exemplary embodiment of the present application.

As shown in FIG. 1, a microfluidic platform according to an embodiment of the present application comprises a microfluidic layer 301 and a contact layer 205 releaseably attached to the microfluidic layer 301 is provided. The microfluidic layer 301 is embedded with a microfluidic structure comprising a micro-channel and a fluidic sample contained in the micro-channel. The contact layer 205 comprises a first heater 211 for heating a first area of the microfluidic structure to a first temperature and a second heater 212 for heating a second area of the microfluidic structure to a second temperature. The microfluidic layer 301 and/or the contact layer 205 are releaseably mounted to a rotation pole 202 and rotate together around the pole 202 during operation.

According to an embodiment, the microfluidic layer 301 may be a disposable layer. Alternatively, it is possible to attach the heaters to the microfluidic layer 301 without providing a contact layer 205. Hereinafter, a disposable microfluidic layer 301 and a separate contact layer 205 will be described. However, a microfluidic layer 301 being attached with heaters also falls into the scope of this application.

The microfluidic structure of the microfluidic layer is shaped such that the sample is under a centrifugal force when the microfluidic layer rotates. For example, the microfluidic structure may be in a shape of spiral as shown in FIG. 1 so that the sample is under a centrifugal force when the microfluidic layer rotates in a direction such as counter-clockwise.

In an example, the micro-channel is an oil-filled channel and the sample is an aqueous droplet. Air bubbles which may be occurred in the micro-channel may lead to undesirable volume expansion and affect operation in the microfluidic structure. The oil does not react with the sample or dissolve the sample. The oil has a density smaller than the sample and bigger than air. Accordingly, the sample and the air which may occur at a certain temperature will move in different directions when the microfluidic layer rotates. The oil inside the micro-channel may be mineral oil. It helps to remove air in the micro-channel and to efficiently heat up sample droplet with uniformity. Since the temperatures of the heaters and the heating areas are remained unchanged and the sample has a small volume, the time for changing the sample temperature is short. If air bubbles are formed in high temperature areas within the micro-channel, they will be driven to move towards a center vent such as the center vent 306 as shown in FIG. 3.

Figure 2:
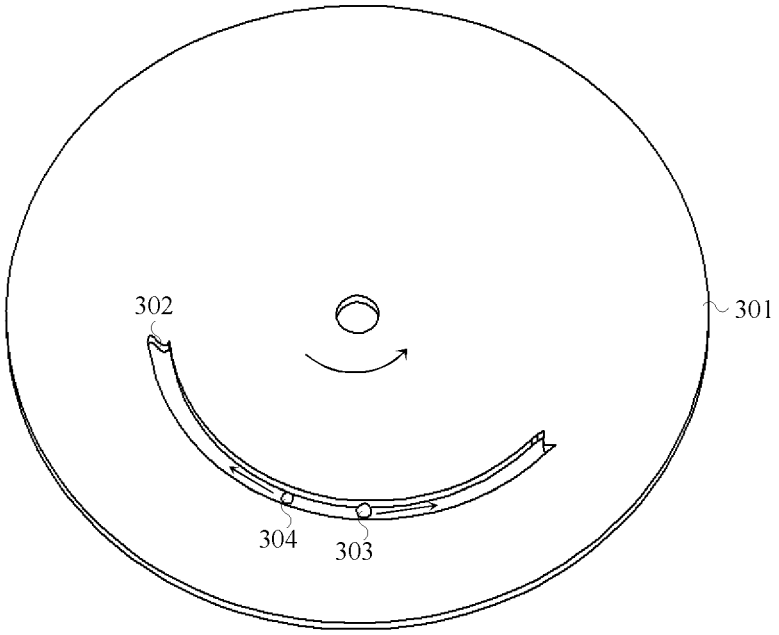
FIG. 2 is a schematic of a microfluidic layer of the microfluidic platform and a section of a micro-channel embedded therein according to an exemplary embodiment of the present application, showing movement of a sample droplet and air bubble in the micro-channel.

FIG. 2 is a schematic of a microfluidic layer 301 and a section of the micro-channel 302 which is embedded in the microfluidic layer. The contact layer 205 may have a symmetric shape, such as a disc shape, for balancing during rotation. Similarly, the microfluidic layer may have a symmetric shape, such as a disc shape, for balancing during rotation. In an example, the micro-channel 302 is filled with oil. The sample is an aqueous droplet 304. Under the centrifugal force, such as the counter-clockwise rotation, the aqueous droplet moves to the right side which is away from the rotation axis 202 and the air bubble 303 moves to the left which is toward to the rotation axis.

Different microfluidic layers may comprise different microfluidic structures for various applications. Meanwhile, the heaters in the contact layer may be arranged into different patterns as desired in various applications. Thus contact layers with different heater arrangements may be selected in accordance with different microfluidic layers.

Figure 3:
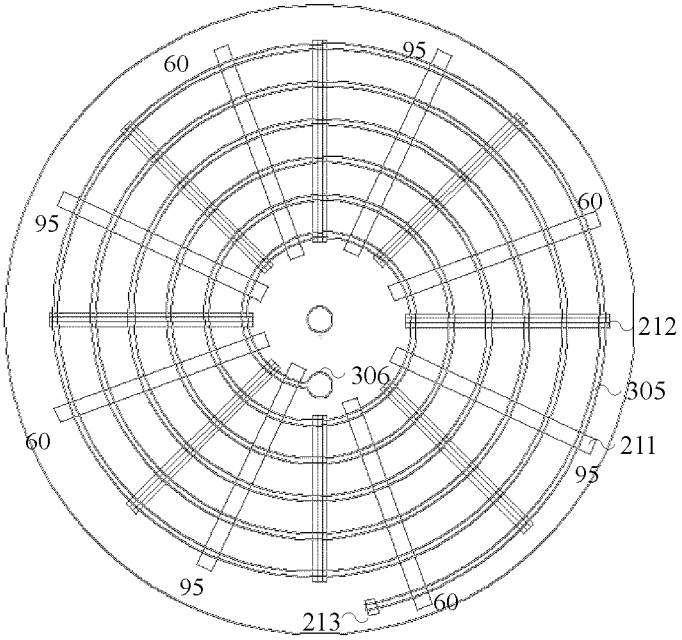
FIG. 3 is a plan view of the microfluidic layer with a microfluidic structure according to an exemplary embodiment of the present application.

FIG. 3 is a plan view of the microfluidic layer 201 contains a microfluidic structure 305 according to an exemplary embodiment of the present invention. The microfluidic structure 305 is in a shape of spiral, which is adapted to applications such as PCR process. As shown in FIG. 3, heaters 211 and 212 are rectangular blocks radially arranged for heating corresponding heating areas of the microfluidic structure 305. When the sample droplet moves to a heating area and is stopped by a passive valve, the temperature of the sample droplet raises to the oil temperature very fast because of the small volume of the sample droplet. The passive valve will be described with reference to FIG. 4 later. After maintaining at the heating area for a predetermined time period, the sample droplet may be moved to a next heating area and is stopped by a passive valve again. Then the temperature of the sample droplet changes to the corresponding oil temperature accordingly. The temperatures of the heaters may be same or different one another, which depends on various applications. A detector, a pair of electrodes or the like may be provided for performing detection or analysis to the sample which is processed.

In the case of the PCR process, the aqueous sample droplet is PCR mix. As known, there are three steps in one temperature cycle of the PCR process: denaturation, annealing and extension. For different PCR mix, the temperatures for the three steps are different. In this embodiment, one cycle has two temperatures: 95° C. 15 seconds for denaturation and 60° C. 1 minute for annealing and extension. To reduce the time of temperature variation, the heaters 211 of 95° C. and the heaters 212 of 60° C. are attached to the micro-channel so that the oil above the heaters has same temperatures as the heaters. When the droplet moves to a heating area corresponding to a heater 211 and is stopped by the passive valve, the temperature of the droplet raises to the oil temperature 95° C. very fast. After the required heating time such as 15 seconds, the droplet moves over the heating area and is stopped at the next heating area corresponding to a heater 212 for the required time such as 1 minute, so that one cycle is finished. A detector 213 may be provided in the micro-channel for performing detection to the sample which has experienced the PCR process. The detector 213 may be provided at the end of the temperature cycling for performing fluorescence based assay. A light source (not shown) may be provided to cooperate with the detector if necessary. For applications requiring electrophoresis, a pair of electrodes may be provided.

For large number of temperature cycles, the microfluidic structure may be a spiral 305, e.g. 8 rings. When 8 heaters are used, 4 cycles will be done in one ring and the total number of cycles for an 8-ring spiral will be 32. Further increase of the number of cycles may be achieved through increasing the numbers of rings and heaters. In the case that multiple cycles are involved, multiple detectors may be placed after the annealing and extension temperature areas so that real-time PCR results may be obtained. By changing the number of heaters and setting the temperatures accordingly, a PCR process with three temperatures may also be realized.

Figure 4:
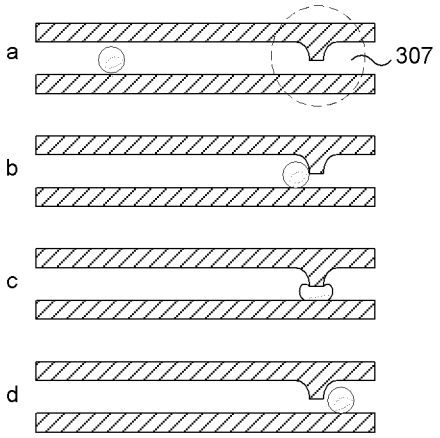
FIG. 4 is a schematic of a valve formed in the microfluidic structure according to an exemplary embodiment of the present application, showing how the sample droplet is stopped and passes through the valve.

FIG. 4 shows a schematic of the passive valve and the operation of the valve, according to an exemplary embodiment of the present application. As shown, the passive valve 307 is in a dashed circle in FIG. 4(*a*) which is a portion of the micro-channel with droplet constriction created by a sudden decrease in channel height. The valve may also be a micro-channel with smaller width or both width and height if the micro-channel has a rectangular cross section or smaller diameter if the channel has round cross section, than the diameter of the sample droplet. When the sample droplet is driven to move with a rotation speed lower than a threshold rotation speed, the droplet is stopped at the valve as shown in FIG. 4(*b*). When the rotation speed is higher than the threshold rotation speed, the sample droplet will squeeze through the valve as shown in FIG. 4(*c*). When the passive valve is used in the microfluidic structure as shown in FIG. 3, the rotation speed for moving the droplets in the micro-channel should be smaller than the threshold speed. At this rotation speed, the valve is closed. After completing heating the sample for a prescribed time, a rotation speed higher than the threshold rotation speed is applied for a short time to force the droplet pass through the valve as shown in FIG. 4(*d*). At this speed, the valve is opened.

There are two types of heating methods: contact or contactless heating. For the contact heating, the heating areas are heated by the attached heaters which are arranged on the contact layer. The heater may be a resistive heater or a Peltier. If conductive material is attached to or deposited in the heating areas, induction heating may be used, which belongs to the contactless heating method. Another contactless heating is through radiation. To reduce the affection between the heating areas of 95° C. and 60° C., a heat sink 214 may be placed on the contact layer for lowering the temperature of the heated sample.

According to an embodiment, the microfluidic platform may further comprise a power generator 203 coupled to and providing power to the contact layer 205 as shown in FIG. 1. The power generator 203 may be wirelessly coupled to the contact layer 205 and supply power to the contact layer through contactless power coupling. For example, the power generator 203 may be split-core transformer, a PCB transformer or the like.

According to an embodiment, the microfluidic platform may further comprise a controller 204 for operations of the microfluidic platform. In particular, the controller 204 may control and maintain the first heater 211 and the second heater 212 to be at the first and second temperatures, respectively. The controller 204 may further control the power generator 203 to provide power to the contact layer 204. The power of the controller 204 may also be supplied by the power generator 203, in a contactless manner, for example. Although the controller 204 is shown as a control layer in FIG. 1, controllers in other forms may also be used.

Figure 5:
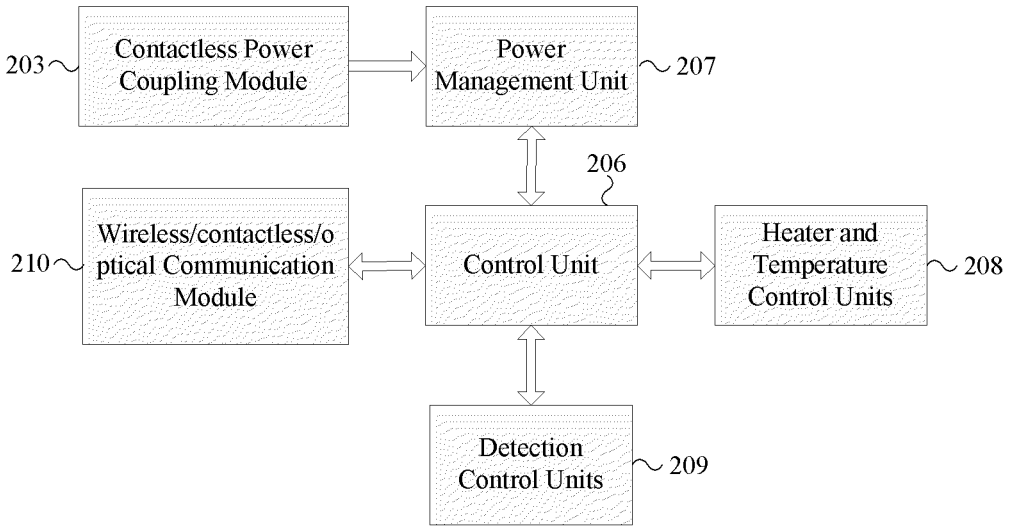
FIG. 5 is a diagram of a control layer of the microfluidic platform according to an exemplary embodiment of the present application.

The controller 204 may control overall functions of the microfluidic platform. FIG. 5 shows a diagram of controller 204 according to an exemplary embodiment. In this embodiment, the control layer comprises a power management unit 207 for managing operation of the contactless power generator 203, a heater and temperature control unit 208 for changing the temperature of the heaters 211 and 212, a detection control unit 209 for controlling the detector 213 on the contact layer 205 and receiving and processing the detected results of reaction, a communication module 210 for transmitting the results to and receiving commands or operation protocol from a computer wirelessly, and a control unit 206 which controls all the above units and modules. The communication methods of the communication module 210 may be wireless methods, such as WiFi, RF, Bluetooth, or contactless coupling coil scheme which transmits and receives data through the split-core transformer, or optical communication which may utilize a pair of optical transmitter and receiver in a hollow rotation pole 202. The control unit 206 may be a microprogrammed control unit (MCU) or digital signal processor (DSP). The detection unit 209 may be a pair of light source and detector for detecting fluorescence signal or a pair of electrodes for electrophoresis analysis. It is understood that one or more of the above units and modules may not be comprised in the controller. Also, one or more other functional units may be provided in the controller.

According to the present application, different microfluidic structures may be used as required and the contact layer may be changed easily for adapting the microfluidic layer with the different microfluidic structures.

In addition, the power supply to the contact layer and/or the control layer is provided through contactless power coupling. If a split-core transformer is used for the power coupling, coils may be arranged in the split-core transformer for data communication.

Hereinabove, illustrative embodiments according to the present application are described with reference to the accompany drawings. However, as obvious for those skilled in the art, it is not necessary to contain all elements mentioned above in one solution. Any suitable combination of the described elements may be combined to implement the present application.

What is claimed is:

1. A microfluidic platform, comprising:

a microfluidic layer comprising a micro-channel configured to receive a fluidic sample, the micro-channel emanating from a center of the microfluidic layer in a spiral curve winding around the center at a continuously increasing distance from the center, the micro-channel having a passive valve defining a constriction resulting in a decreased cross-section of the micro-channel; and a contact layer attachable to the microfluidic layer, comprising a first heater for heating a first section of the micro-channel to a first temperature and a second heater for heating a second section of the micro-channel to a second temperature, wherein the passive valve is arranged to delineate the first section and the second section wherein in operation, the microfluidic layer and the contact layer co-rotate to exert a force on the fluidic sample in the micro-channel, the micro-channel is configured to be filled with oil until substantially full such that the oil in the microchannel is substantially immobile as a whole, and the fluidic sample is an aqueous droplet; and the fluidic sample is stopped by the passive valve when a rotational speed of the microfluidic layer is lower than a threshold rotational speed, and the fluidic sample is squeezed through the one of the plurality of passive valves when the rotational speed of the microfluidic layer is higher than the threshold rotational speed.

2. The microfluidic platform of claim 1, wherein the contact layer further comprises a third heater for heating a third section of the microfluidic structure to a third temperature.

3. The microfluidic platform of claim 1, wherein the contact layer further comprises a heat sink between the first and second heater for lowering a temperature of the fluidic sample when the fluidic sample is passing a fourth section of the microfluidic structure corresponding to the heat sink.

4. The microfluidic platform of claim 1, further comprising:

a controller configured to control and maintain the first and second heaters to be at the first and second temperatures, respectively.

5. The microfluidic platform of claim 1, further comprising:

a power generator coupled to and providing power to the contact layer.

6. The microfluidic platform of claim 5, wherein the power generator is wirelessly coupled to the contact layer.

7. The microfluidic platform of claim 5, further comprising:

a controller configured to control and maintain the first and second heaters to be at the first and second temperatures, respectively.

8. The microfluidic platform of claim 7, wherein the controller is further configured to control the power generator to provide power to the contact layer.

9. The microfluidic platform of claim 1, wherein a detector is arranged at the micro-channel for performing detection on the sample.

10. The microfluidic platform of claim 1, wherein a pair of electrodes are arranged at the micro-channel for performing electrophoresis on the sample.

11. The microfluidic platform of claim 1, wherein the heater is a resistive thin film heater, Peltier heater, or an induction heater.

12. A method for moving and heating a fluidic sample, the method comprising:

receiving a fluidic sample in a planar spiral path, the spiral path emanating from a center in a spiral curve winding around the center at a continuously increasing distance from the center, the spiral path having a first section, a second section, and a constriction between the first section and the second section;

rotating the fluidic sample at a rotational speed lower than a threshold rotational speed so that the fluidic sample is stopped by the constriction and remains in the first section;

heating the fluidic sample to a first temperature;

rotating the fluidic sample at the rotational speed higher than the threshold rotational speed so that the fluidic sample squeezes through the constriction to enter the second section; and heating the fluidic sample to a second temperature in the second section.

13. The method of claim 12, the method further comprising:

receiving oil to substantially full in the planar spiral path.

14. The method of claim 13, the method further comprising:

heating the oil in the first section to the first temperature, and heating the oil in the second section to the second temperature.

15. The method of claim 12, wherein the fluidic sample is moved and maintained repeatedly.

* * * * *